US012201142B2

(12) United States Patent
Cherkas et al.

(10) Patent No.: US 12,201,142 B2
(45) Date of Patent: Jan. 21, 2025

(54) FILTER FOR SMOKING OR VAPING ARTICLE COMPRISING A NONWOVEN SUBSTRATE

(71) Applicant: SWM Holdings US, LLC, Alpharetta, GA (US)

(72) Inventors: Oxana Cherkas, Le Mans (FR); Diane M. Raverdy-Lambert, Le Mans (FR)

(73) Assignee: SWM Holdings US, LLC, Atlanta, GA (US)

( * ) Notice: Subject to any disclaimer, the term of this patent is extended or adjusted under 35 U.S.C. 154(b) by 120 days.

(21) Appl. No.: 17/471,497

(22) Filed: Sep. 10, 2021

(65) Prior Publication Data

US 2022/0079216 A1 Mar. 17, 2022

(30) Foreign Application Priority Data

Sep. 11, 2020 (FR) ..... 20 09244

(51) Int. Cl.

| | |
|---|---|
| ***A24D 3/10*** | (2006.01) |
| ***A24D 1/04*** | (2006.01) |
| ***A24D 1/20*** | (2020.01) |
| ***A24D 3/02*** | (2006.01) |
| ***A24D 3/06*** | (2006.01) |
| ***A24D 3/14*** | (2006.01) |
| ***A24D 3/17*** | (2020.01) |

(52) U.S. Cl.

CPC ..... *A24D 3/10* (2013.01); *A24D 1/045* (2013.01); *A24D 1/20* (2020.01); *A24D 3/022* (2013.01); *A24D 3/0229* (2013.01); *A24D 3/0254* (2013.01); *A24D 3/063* (2013.01); *A24D 3/14* (2013.01); *A24D 3/17* (2020.01)

(58) Field of Classification Search

CPC . A24D 1/20; A24D 1/045; A24D 3/10; A24D 3/14; A24D 3/17; A24D 3/022; A24D 3/063; A24D 3/0229; A24D 3/0254

See application file for complete search history.

(56) References Cited

U.S. PATENT DOCUMENTS

| | | | |
|---|---|---|---|
| 2,968,306 | A | 1/1961 | Touey et al. |
| 3,019,794 | A | 2/1962 | Whitmore et al. |
| 3,227,164 | A | 1/1966 | Touey et al. |
| 3,353,541 | A | 11/1967 | Hind et al. |
| 3,386,449 | A | 6/1968 | Hind |
| 3,400,723 | A | 9/1968 | Adolf et al. |
| 3,415,253 | A | 12/1968 | Michels et al. |
| 3,420,241 | A | 1/1969 | Hind et al. |
| 3,428,053 | A | 2/1969 | Schoenbaum et al. |
| 3,467,109 | A | 9/1969 | Block et al. |
| 3,483,874 | A | 12/1969 | Hind |
| 3,561,451 | A | 2/1971 | Jacin et al. |
| 3,608,564 | A | 9/1971 | Takahashi et al. |
| 3,760,815 | A | 9/1973 | Deszyck |
| 3,847,164 | A | 11/1974 | Mattina et al. |
| 3,860,012 | A | 1/1975 | Selke |
| 4,182,349 | A | 1/1980 | Selke |
| 4,355,995 | A | 10/1982 | Berger |
| 4,674,519 | A | 6/1987 | Keritsis et al. |
| 5,025,814 | A | 6/1991 | Raker |
| 5,360,023 | A | 11/1994 | Blakley et al. |
| 5,439,010 | A | 8/1995 | Ross |
| 5,678,577 | A | 10/1997 | Matsumura et al. |
| 5,698,627 | A | 12/1997 | Oguni et al. |
| 5,715,844 | A | 2/1998 | Young et al. |
| 5,724,998 | A | 3/1998 | Gellatly et al. |
| 5,765,570 | A | 6/1998 | Litzinger et al. |
| 5,856,006 | A | 1/1999 | Asai et al. |
| 6,310,132 | B1 | 10/2001 | Sackmann et al. |
| 6,344,239 | B1 | 2/2002 | Asai et al. |
| 6,457,475 | B1 | 10/2002 | Tani et al. |
| 6,503,604 | B1 | 1/2003 | Kesahara et al. |
| 6,666,952 | B2 | 12/2003 | Dilts et al. |
| 6,676,806 | B1 | 1/2004 | Butt, Sr. |
| 6,749,721 | B2 | 6/2004 | Shannon et al. |
| 7,900,639 | B2 | 3/2011 | Perfetti et al. |
| 8,333,872 | B2 | 12/2012 | Propst, Jr. et al. |
| 8,425,726 | B2 | 4/2013 | Buwono et al. |
| 8,434,498 | B2 | 5/2013 | Sebastian |
| 8,597,667 | B2 | 12/2013 | Mou et al. |
| 2003/0183239 | A1 | 10/2003 | Lesser et al. |
| 2010/0087117 | A1 | 4/2010 | Peyras-Carratte et al. |
| 2011/0023900 | A1 | 2/2011 | Clarke et al. |
| 2012/0067359 | A1 | 3/2012 | Clarke et al. |
| 2012/0120229 | A1 | 5/2012 | Brantley et al. |
| 2013/0025611 | A1 | 1/2013 | Rushforth et al. |
| 2013/0137561 | A1 | 5/2013 | Sampson et al. |
| 2014/0287216 | A1 | 9/2014 | Decorme et al. |

FOREIGN PATENT DOCUMENTS

| | | | | |
|---|---|---|---|---|
| CN | 101167601 | A | 4/2008 | |
| CN | 103120364 | A | 5/2013 | |
| GB | 2075328 | A | 5/1984 | |
| GB | 2525363 | A * | 10/2015 | ..... A24D 3/10 |
| WO | WO2004022850 | A1 | 3/2004 | |
| WO | WO2006107847 | A2 | 10/2006 | |
| WO | WO2016002756 | A1 | 1/2016 | |
| WO | WO2019122128 | A1 | 6/2019 | |
| WO | WO2022053625 | A1 | 3/2022 | |

OTHER PUBLICATIONS

Gérard Coste: "Les non-tissés—La fabrication des non tissés", May 19, 2005 XP002803038. Retrieved from the Internet: http://cerig.efpg.inpg.fr/tutoriel/non-tisse/page03.htm.

* cited by examiner

*Primary Examiner* — Christopher M Rodd
*Assistant Examiner* — Ronnie Kirby Jordan
(74) *Attorney, Agent, or Firm* — Dority & Manning, P.A.

(57) ABSTRACT

The present invention relates to a filter comprising a nonwoven substrate having a low density and comprising natural fibers and a binder. The filter can be used as a filter for a smoking or vaping article.

16 Claims, No Drawings

FILTER FOR SMOKING OR VAPING ARTICLE COMPRISING A NONWOVEN SUBSTRATE

RELATED APPLICATIONS

The present application is based upon and claims priority to French Patent Application No. FR 20 09244 having a filing date of Sep. 11, 2020, which is incorporated herein by reference.

TECHNICAL FIELD

A subject of the invention is a filter comprising a nonwoven substrate having a low density and comprising natural fibers and a binder. This nonwoven substrate is capable of being obtained by an airlaid process. This filter can be used as filter for a smoking or vaping article.

PRIOR ART

A filter for a smoking or vaping article has a right circular cylindrical shape and generally comprises an outer envelope of plug wrap paper and a substrate located within the outer envelope. The filter for a smoking or vaping article, by virtue of the substrate, makes it possible to prevent the user from inhaling tobacco particles and allows retention of the harmful particulate substances contained in the smoke or the aerosol, such as tar.

Filters are commonly made from cellulose acetate. These cellulose acetate filters have a nicotine retention capacity such that the user's perception of the filtered smoke is satisfactory. In addition, these filters generate a filtered smoke having good organoleptic properties. However, these cellulose acetate substrates degrade very slowly and are not dispersible in water. This is particularly harmful since the filter is not consumed during the smoking/vaping of a smoking/vaping article and is regularly found in the environment. Cellulose acetate substrates thus have a significant environmental impact.

To limit the environmental impact of conventional filters, it has been proposed to replace the cellulose acetate with paper. As paper substrates are biodegradable, they degrade rapidly. However, the nicotine retention capacity of filters comprising a paper substrate is such that the user's perception of the filtered smoke may not be satisfactory. In addition, the smoke filtered by filters comprising a paper substrate may have a drying taste which is unsatisfactory for the user. The user experience provided by these paper substrates is thus not as satisfactory when compared with cellulose acetate.

Technical Problem

There is therefore a need for a filter which has a nicotine retention capacity of the same order of magnitude as that of a filter comprising a cellulose acetate substrate, which provides a satisfactory user experience, which can degrade rapidly and which is dispersible in water.

It is thus to the credit of the inventors to have found that it was possible to meet this need by means of a nonwoven substrate.

SUMMARY

It is proposed a filter comprising a nonwoven substrate comprising natural fibers and a binder, in which the natural fibers represent between 70% and 99%, in particular between 80% and 98%, very particularly between 85% and 98% by weight of solids of said nonwoven substrate, the binder represents between 1% and 30%, in particular between 2% and 20%, very particularly between 2% and 15% by weight of solids of said nonwoven substrate, characterized in that the nonwoven substrate has a density of between 10 mg/cm$^3$ and 60 mg/cm$^3$, in particular between 15 mg/cm$^3$ and 55 mg/cm$^3$, very particularly between 20 mg/cm$^3$ and 45 mg/cm$^3$.

Advantageously, the filter of the invention has a nicotine retention capacity of the same order of magnitude as the retention capacities of a filter comprising a cellulose acetate substrate. Consequently, the user's perception of the smoke filtered by the filter of the invention is satisfactory.

The nonwoven substrate of the filter of the invention can also degrade very rapidly in the environment and is dispersible in water. This is particularly advantageous as the environmental impact of the filter is very small.

Moreover, the smoke filtered by the filter of the invention has organoleptic properties which are satisfactory for the user.

The nonwoven substrate of the filter of the invention can also make it possible to produce said filter without a prior shaping step, which is not the case for paper substrates. Thus, the process for producing the filter of the invention is simplified.

According to another aspect, a process is proposed for producing the filter of the invention comprising a nonwoven substrate, said process comprising the following steps:

a) forming a rod of nonwoven substrate from a nonwoven substrate, b) wrapping the rod of nonwoven substrate with a sheet of plug wrap paper, c) depositing an adhesive line, joining the sheet of plug wrap paper to obtain a rod of filtering material, d) cutting the rod of filtering material to produce the filter, wherein the nonwoven substrate is as defined above or is obtained by a process comprising the following steps:

i) producing a web from natural fibers by an airlaid process, ii) introducing the binder into the web, and iii) drying the web resulting from step ii) to obtain the nonwoven substrate.

DETAILED DESCRIPTION OF THE INVENTION

It is proposed a filter comprising a nonwoven substrate comprising natural fibers and a binder, in which the natural fibers represent between 70% and 99%, in particular between 80% and 98%, very particularly between 85% and 98% by weight of solids of said nonwoven substrate, the binder represents between 1% and 30%, in particular between 2% and 20%, very particularly between 2% and 15% by weight of solids of said nonwoven substrate;

characterized in that the nonwoven substrate has a density of between 10 mg/cm$^3$ and 60 mg/cm$^3$, in particular between 15 mg/cm$^3$ and 50 mg/cm$^3$, very particularly between 20 mg/cm$^3$ and 45 mg/cm$^3$.

Compared to the conventional density of paper substrates, which is greater than 300 mg/cm$^3$, the density of the nonwoven substrate is very low.

Without wishing to be bound by any theory, the inventors are of the opinion that, by virtue of this low density, the nonwoven substrate of the filter of the invention has a higher filter filling power than the filling power of a paper substrate. This higher filling power makes it possible to reduce the amount of nonwoven substrate present in the filter such that the filter of the invention has a nicotine retention capacity of the same order of magnitude as the retention capacity of a filter comprising a cellulose acetate substrate.

For the purposes of the present application, "nonwoven substrate" (also referred to as "non-woven substrate") denotes a manufactured sheet consisting of a web or ply of directionally or randomly oriented fibers bonded together by friction and/or cohesion and/or adhesion.

Typically, the density of the nonwoven substrate is calculated by dividing its grammage by its thickness.

The standard ISO 536:2012 can be used to determine the grammage of the nonwoven substrate. The substrate is conditioned for at least 16 hours at 23° C. and 50% relative humidity before the measurement.

To measure the thickness of the nonwoven substrate, it is possible to use a dead-weight micrometer comprising a 25 $cm^2$ measuring head with two planar, parallel and circular pressure surfaces. During the measurement, the nonwoven substrate is placed between the two pressure surfaces for 10 seconds. The pressure exerted between the pressure surfaces during the measurement of the thickness is 0.5 kPa. The substrate is conditioned for at least 16 hours at 23° C. and 50% relative humidity before the measurement.

The grammage of the nonwoven substrate of the filter of the invention can for example be between 25 $g/m^2$ and 65 $g/m^2$, in particular between 30 $g/m^2$ and 60 $g/m^2$, more particularly between 35 $g/m^2$ and 55 $g/m^2$.

The thickness of the nonwoven substrate of the filter of the invention can for example be between 700 μm and 4000 μm, in particular between 900 μm and 3000 μm, more particularly between 1200 μm and 2500 μm.

According to one particular embodiment, the nonwoven substrate can have a density of between 20 $mg/cm^3$ and 45 $mg/cm^3$, and a thickness of between 1200 μm and 2500 μm.

The person skilled in the art will know how to adapt the grammage and the thickness of the nonwoven substrate in order to achieve the desired density.

For the purposes of the present application, the term "natural fiber" denotes a fiber of natural origin which has optionally undergone a chemical treatment, a physical treatment, or both, in order to improve the physical characteristics thereof.

For example, the natural fibers can be chosen from wood fibers, leaf fibers, fruit fibers, seed fibers, bast fibers, stalk fibers, reed fibers, and mixtures thereof, in particular from wood fibers, leaf fibers, seed fibers, bast fibers, and mixtures thereof, more particularly from wood fibers and mixtures thereof. Examples of wood fibers which may be present in the nonwoven substrate of the filter of the invention can be hardwood pulp, bleached hardwood pulp, softwood pulp, bleached softwood pulp, softwood fluff pulp, lyocell fibers (cellulose fibers which are ground and dissolved in N-methylmorpholine N-oxide monohydrate for the purpose of obtaining fibers with a cross section of variable shape (round, oval, cross-shaped, circular, lamellar cross section) with calibrated length and mass per unit length, which the person skilled in the art can choose depending on their needs), viscose fibers (fibers obtained by dissolving cellulose by means of modification of its hydroxyl groups by carbon disulfide ($CS_2$) and then its precipitation in the presence of sulfuric acid ($H_2SO_4$) for the purpose of obtaining fibers with a cross section of variable shape (round, oval, cross-shaped, circular, lamellar cross section) with calibrated length and mass per unit length, which the person skilled in the art can choose depending on their needs), and mixtures thereof, in particular hardwood pulp, softwood pulp, softwood fluff pulp, lyocell fibers, viscose fibers, and mixtures thereof, more particularly softwood pulp, softwood fluff pulp, lyocell fibers, and mixtures thereof.

For the purposes of the present application, "bast fiber" denotes a plant fiber contained in the bast of the plants.

As bast fiber, mention may be made of hemp fiber, Indian hemp fiber, jute fiber, kenaf fiber, kudzu fiber, coin vine fiber, flax fiber, okra fiber, nettle fiber, papyrus fiber, ramie fiber, sisal fiber, esparto fiber, and mixtures thereof, in particular hemp fiber, flax fiber, and a mixture thereof, more particularly flax fiber.

Typically, the bast fibers may have undergone prior treatment. Thus, the bast fibers may be cottonized bast fibers, individualized bast fibers, bast fibers which have undergone retting, bleached bast fibers, and mixtures thereof, in particular cottonized bast fibers, individualized bast fibers and a mixture thereof.

For the purposes of the present application, "seed fiber" denotes a fiber obtained from seeds of a plant. Examples of seed fibers can be cotton fiber, kapok fiber, luffa fiber, milkweed fiber, and mixtures thereof, in particular kapok fiber.

According to one particular embodiment, the natural fibers are chosen from softwood pulp, softwood fluff pulp, in particular softwood fluff pulp.

According to the invention, the natural fibers have a length of between 1 mm and 10 mm, in particular between 1.5 mm and 8 mm, very particularly between 2 mm and 5 mm.

An airlaid process is particularly suitable for these sizes of natural fibers. Thus, the nonwoven substrate of the filter of the invention can be obtained by an airlaid process.

The length of the natural fibers can be measured by microscopic measurement using a projection microscope by means of the necessary magnification.

The natural fibers may also be cut so as to have a length within the ranges mentioned above. Conventional cutting techniques which can be used are guillotine cutting of natural fibers, grinding of the natural fibers with or without a system for removing excessively short and excessively long fibers of air cyclone or screen type.

For the purposes of the present application, "binder" denotes a compound having properties enabling consolidation of the nonwoven substrate. Advantageously, water-soluble binders will be chosen. Water-soluble is understood to refer to the ability of the binder to dissolve in water at a temperature and with stirring which are controlled, to form a homogeneous solution at ambient temperature and not a suspension. After drying of the substrate with this binder, the substrate is dispersible since the binder is soluble in water. Advantageously, the nonwoven substrate is dispersible in water at ambient temperature in less than 60 s. To measure the time required for dispersion, the experimental conditions of example 4 can be used.

For example, the binder can be chosen from a polysaccharide, a cellulose derivative, a polyvinyl alcohol (PVOH) and mixtures thereof.

The polysaccharide which can be used as binder can be a polysaccharide or a polysaccharide derivative. For example, starch, dextrin, gum arabic, and mixtures thereof can be used as binder, in particular starch.

For example, the cellulose derivative can be chosen from ethyl cellulose, methyl cellulose, hydroxymethyl cellulose, hydroxyethyl cellulose, carboxymethyl cellulose, an alkali metal salt of carboxymethyl cellulose, and mixtures thereof, in particular carboxymethyl cellulose. A carboxymethyl cellulose with a degree of substitution of greater than 0.4 is particularly advantageous. Typically, the degree of substitution will be between 0.6-0.9.

As alkali metal of the carboxymethyl cellulose salt, mention may be made of potassium, sodium, and magnesium.

Polyvinyl alcohol may also be used as binder, in particular polyvinyl alcohol with a degree of hydrolysis of less than 99%, less than 95%, or less than 90%.

According to a very particular embodiment, the nonwoven substrate comprises softwood fluff pulp and a binder chosen from starch, carboxymethyl cellulose or polyvinyl alcohol, in which the softwood fluff pulp represents between 85% and 95% by weight of solids of said nonwoven substrate and the binder represents between 5% and 15% by weight of solids of said nonwoven substrate; and has a density of between 20 $mg/cm^3$ and 45 $mg/cm^3$.

The nonwoven substrate of this very particular embodiment can be obtained by an airlaid process.

Advantageously, the nonwoven substrate of the filter of the invention obtained by an airlaid process is dispersible very rapidly in water at ambient temperature.

The filter of the invention may be a filter for a smoking or vaping article comprising a nonwoven substrate of the invention as defined above.

For the purposes of the present application, "smoking article" denotes an article comprising tobacco and/or any other plant intended to be smoked. For example, the smoking article may be a machine-manufactured cigarette, a roll-your-own cigarette or a make-your-own cigarette.

Typically, the filter for a smoking article has a right circular cylindrical shape and comprises an outer envelope of plug wrap paper for a smoking article, in particular for a cigarette, and the nonwoven substrate of the filter of the invention as defined above located within the outer envelope.

For the purposes of the present application, "vaping article" denotes an article comprising tobacco and/or any other plant intended to be vaped, which is intended to be inserted into a device which heats the tobacco and/or the plant without burning said tobacco/plant and which enables delivery of an aerosol to a user. For example, the vaping article can be a tobacco stick.

Typically, the filter for a vaping article has a right circular cylindrical shape and comprises an outer envelope of plug wrap paper for a vaping article, in particular for a tobacco stick, and the nonwoven substrate of the filter of the invention as defined above located within the outer envelope.

The filter of the invention can have a density of between 100 $mg/cm^3$ and 200 $mg/cm^3$, in particular between 110 $mg/cm^3$ and 175 $mg/cm^3$, more particularly between 120 $mg/cm^3$ and 160 $mg/cm^3$.

Typically, the density of the filter is measured after manufacture of the filters, by dividing the mass of the filter by its volume. For a filter having a right circular cylindrical shape, the volume of the filter ($V_{filter}$) is calculated by the following formula: $V_{filter}=\pi*L*r^2$, in which r denotes the radius of the filter and L denotes the length of the filter.

The nonwoven substrate of the filter of the invention may not be shaped in the filter. In particular, the nonwoven substrate of the filter of the invention may not be folded in a V shape and/or crimped in the filter. This is highly advantageous since it makes it possible to produce a filter without a step of shaping the substrate, and hence to simplify the production of the filter.

According to another aspect, the present invention also relates to a smoking article comprising a filter as defined above.

According to another aspect, the present invention also relates to a vaping article comprising a filter as defined above.

The present invention also relates to the use of a nonwoven substrate as defined above in a filter, in particular a filter for a smoking article or a filter for a vaping article.

The present invention also relates to a process for producing the filter of the invention comprising a nonwoven substrate, said process comprising the following steps:

a) forming a rod of nonwoven substrate from a nonwoven substrate, b) wrapping the rod of nonwoven substrate with a sheet of plug wrap paper, c) depositing an adhesive line, joining the sheet of plug wrap paper to obtain a rod of filtering material, d) cutting the rod of filtering material to produce the filter, wherein the nonwoven substrate is as defined above or is obtained by a process comprising the following steps:

i) producing a web from natural fibers by an airlaid process, ii) introducing the binder into the web, and iii) drying the web resulting from step ii) to obtain the nonwoven substrate.

The nonwoven substrate, the natural fibers and the binder are as described above in relation to the nonwoven substrate.

The nonwoven substrate of the filter of the invention can therefore be obtained by an airlaid process.

The airlaid process and the drylaid process are two different conventional routes known to the person skilled in the art to produce a web. The person skilled in the art will know how to adapt the parameters of the airlaid process to produce the nonwoven substrate of the filter of the invention.

The process of the invention can comprise, before production step i), a step i1) of cutting the natural fibers to obtain natural fibers having a length within the ranges mentioned above.

Cutting step i1) can be carried out by conventional techniques such as guillotine cutting, grinding of the natural fibers with or without a system for removing excessively short and excessively long fibers of air cyclone or screen type.

During introduction step ii), an aqueous dispersion of the binder is introduced into the web. This introduction may for example be carried out by impregnation, such as impregnation with a size press, by spraying, such as spraying using a spray, by surface application, such as surface application by coating or by printing, in particular by spraying using a spray. Advantageously, the spraying will be performed on both faces of the web.

The aqueous dispersion of the binder can be obtained by any technique known to the person skilled in the art. The person skilled in the art will know how to adapt the concentration of binder in the aqueous dispersion to obtain the desired content of binder in the nonwoven substrate of the invention.

Drying step iii) can, for example, be carried out by a drying device, such as a tunnel through which air passes or an infrared ramp.

This drying step iii) can be carried out at a temperature of between 75° C. and 220° C., in particular between 90° C. and 200° C., more particularly between 100° C. and 190° C. A temperature within these ranges advantageously makes it possible to minimize the duration of this drying step iii) while at the same time minimizing the deterioration of the natural fibers of the nonwoven substrate, thus optimizing the process of the invention.

Advantageously, the combination of the introduction step ii) and of the drying step iii) makes it possible to improve the cohesion of the natural fibers and hence to consolidate the structure of the nonwoven substrate of the invention.

The natural fibers used in production step i) can be a mixture of natural fibers. This mixture of natural fibers can be obtained before production step i).

The process may also comprise, between production step i) and introduction step ii), a step ii1) of compacting the web to obtain a compacted web, this compacted web then undergoing introduction step ii).

This compacting step ii1) can make it possible to reduce the thickness of the web in order to control the density of the nonwoven substrate.

According to a very particular embodiment, the process can comprise the following steps:

i) producing a web from a softwood fluff pulp by an airlaid process, ii) introducing a binder chosen from starch, carboxymethyl cellulose or polyvinyl alcohol into the web by spraying an aqueous dispersion of the binder, and iii) drying the web resulting from step ii) to obtain a nonwoven substrate which can have a density of between 20 $mg/cm^3$ and 45 $mg/cm^3$ and in which the softwood fluff pulp can represent between 85% and 95% by weight of solids of said nonwoven substrate and the starch can represent between 5% and 15% by weight of solids of said nonwoven substrate.

Optionally, the nonwoven substrate obtained at step iii) may be calendered.

After step iii) and before step a), the nonwoven substrate may be packed as bobbin, as roll by a spooling process or in paperboard by a festooning process.

EXAMPLES

Example 1: Manufacture of the Nonwoven Substrate

In the Examples, the air permeability is determined using "FX3300 Lab Air IV" Air permeability tester. During the measurements, the tested web is placed under the measurement head and we measured the air flow passing through the web at pressure drop of 200 Pa over the area of 20 $cm^2$. The permeability is measured in [$cm^3/cm^2/sec$]. For each sample, three measurements were made and the indicated air permeability is the average value.

Example 1.1: Nonwoven Substrate Prepared by an Airlaid Process and Comprising 92% by Weight of Solids of Said Nonwoven Substrate of Softwood Fluff Pulp and 8% by Weight of Solids of Said Nonwoven Substrate of Starch The softwood fluff pulp was ground and deposited on a forming fabric by an airlaid process to obtain a web. A solution comprising 0.7% solids content of starch (Perfectafilm X115 manufactured by Avebe) is sprayed onto both sides of the web. The sprayed web is then dried by infrared and hot air oven at a temperature of between 180° C. and 190° C.

The nonwoven substrate obtained has a density of 30 $mg/cm^3$, a thickness of 1530 μm, a grammage of 46 $g/m^2$ and an air permeability of 440 $cm^3 \cdot cm^{-2} \cdot sec^{-1}$.

Example 1.2: Nonwoven Substrate Prepared by an Airlaid Process and Comprising 85% by Weight of Solids of Said Nonwoven Substrate of Softwood Fluff Pulp and 15% by Weight of Solids of Said Nonwoven Substrate of Starch The nonwoven substrate is obtained by the process described in example 1.1 with 37 $g/m^2$. Before spraying with starch with 1.27% solids content, the web was compacted with a pressure of 1 bar. The content of binder in the web after drying is 15%.

The nonwoven substrate obtained has a density of 41 $mg/cm^3$, a thickness of 900 μm, a grammage of 37 $g/m^2$ and an air permeability of 345 $cm^3 \cdot cm^{-2} \cdot sec^{-1}$.

Example 1.3: Nonwoven Substrate Prepared by an Airlaid Process and Comprising 95% by Weight of Solids of Said Nonwoven Substrate of Softwood Fluff Pulp and 5% by Weight of Solids of Said Nonwoven Substrate of Carboxymethyl Cellulose The nonwoven substrate is obtained by the process described in example 1.1. A solution comprising 0.7% solids content of carboxymethyl cellulose (Blanose 7LCF with a degree of substitution of 0.65-0.9, manufactured by Ashland) is sprayed onto both sides of the web. The content of binder in the web after drying is 5%.

The nonwoven substrate obtained has a density of 21 $mg/cm^3$, a thickness of 2340 μm, a grammage of 51 $g/m^2$ and an air permeability of 407 $cm^3 \cdot cm^{-2} \cdot sec^{-1}$.

Example 1.4: Nonwoven Substrate Prepared by an Airlaid Process and Comprising 92% by Weight of Solids of Said Nonwoven Substrate of Softwood Fluff Pulp and 8% by Weight of Solids of Said Nonwoven Substrate of Highly Hydrolyzed Polyvinyl Alcohol The nonwoven substrate is obtained by the process described in example 1.1. A solution comprising 0.8% solids content of polyvinyl alcohol (Elvanol 71-30 with a degree of hydrolysis of 99.5%, manufactured by Kuraray) is sprayed onto both sides of the web. The content of binder in the web after drying is 8%.

The nonwoven substrate obtained has a density of 21 $mg/cm^3$, a thickness of 1900 μm, a grammage of 40 $g/m^2$ and an air permeability of 403 $cm^3 \cdot cm^{-2} \cdot sec^{-1}$.

Example 1.5: Nonwoven Substrate Prepared by an Airlaid Process and Comprising 92% by Weight of Solids of Said Nonwoven Substrate of Softwood Fluff Pulp and 8% by Weight of Solids of Said Nonwoven Substrate of Partially Hydrolyzed Polyvinyl Alcohol The nonwoven substrate is obtained by the process described in example 1.1. A solution comprising 0.87% solids content of polyvinyl alcohol (Poval 6-88 with a degree of hydrolysis of 88%, manufactured by Kurary) is sprayed onto both sides of the web. The content of binder in the web after drying is 8%.

The nonwoven substrate obtained has a density of 24 $mg/cm^3$, a thickness of 1690 μm and a grammage of 41 $g/m^2$ and an air permeability of 480 $cm^3 \cdot cm^{-2} \cdot sec^{-1}$.

Example 2: Manufacture and Characterization of Filters for a Smoking Article Filters for a smoking article were manufactured with the substrates of examples 1.1 to 1.4 by a standard method for manufacturing filters without passage through a crimping machine. A nonporous plug wrap paper was used to wrap the rods of nonwoven filtering material.

The filters of the invention were compared with the paper filter and with the commercial cellulose acetate filter. The paper filter was made using a standard method for manufacturing filters by crimping the substrate CF 36 of 36 $g/m^2$ and 100 μm thickness. The filters obtained for each term were cut into 21-mm sticks.

The characteristics of the filters are given in table 1 below.

TABLE 1

| | Commercial cellulose acetate filter | Filter comprising the substrate of example 1-1 | Filter comprising the substrate of example 1-2 | Filter comprising the substrate of example 1-3 | Filter comprising the substrate of example 1-4 | Filter made from crimped CF36 paper |
|---|---|---|---|---|---|---|
| Length of the filters [mm] | 21 | | | | | |
| Diameter of the filters [mm] | 7.8 | | | | | |
| Weight of the filters [mg] | 139 ± 5 | 124 ± 1 | 151 ± 1 | 118 ± 1 | 120 ± 1 | 221 ± 1 |
| Density of the filters [mg/cm$^3$] | 138 | 127 | 154 | 120 | 111 | 226 |

Example 3: Manufacture and Characterization of Cigarettes

Cigarettes were prepared using the filters described in example 2. To form the cigarettes, the rods of tobacco were assembled with the filters using tipping paper. A commercial "American blend" tobacco was used to form the rods of tobacco. The cigarettes were prepared with a pressure drop similar to that of the commercial cigarette. The ventilation of the cigarettes was blocked.

The cigarettes prepared were smoked on a Borgwaldt RM20 smoking machine in accordance with the standard ISO 3308:2000. The pressure drop (PD in Table 2) was measured in accordance with the standard ISO 6565:2002. The nicotine content in the smoke was measured in accordance with the standard ISO 10315:2000. The smoking results are given in Table 2 below.

TABLE 2

| | Commercial cellulose acetate filter | Filter comprising the substrate of example 1-1 | Filter comprising the substrate of example 1-2 | Filter comprising the substrate of example 1-3 | Filter comprising the substrate of example 1-4 | Filter made from crimped CF36 paper |
|---|---|---|---|---|---|---|
| Number of cigarettes smoked | 30 | | | | | |
| PD of the cigarettes [mmWC] | 104 ± 1 | 100 ± 1 | 95 ± 1 | 106 ± 1 | 90 ± 1 | 100 ± 1 |
| Nicotine [mg/cigarette] | 0.85 ± 0.04 | 0.80 ± 0.10 | 0.79 ± 0.01 | 0.71 ± 0.04 | 0.87 ± 0.05 | 0.5 ± 0.19 |

Table 2 demonstrates that, with an equivalent pressure drop, the cigarettes with filters according to the invention and the cigarettes comprising a commercial cellulose acetate filter have a nicotine content in the smoke which is of the same order of magnitude, whereas the cigarettes comprising a filter made from crimped paper have a much lower nicotine content in the smoke.

This example 3 thus demonstrates that the user experience provided by the cigarettes comprising the filters according to the invention is as satisfactory as that provided by cigarettes comprising a commercial cellulose acetate filter.

Example 4: Dispersion of the Filters in Water at Ambient Temperature

The filters comprising the substrates of example 1 without plug wrap paper, a commercial cellulose acetate filter without plug wrap paper and a paper filter without plug wrap paper were independently placed in 100 ml of tap water at 22° C. and stirred manually at 60 rpm for 30 sec every 4 hours to verify the dispersion thereof in the water. The time required for the fibers to detach from one another was noted. This time is indicated in table 3.

TABLE 3

| | Commercial cellulose acetate filter | Filter comprising the substrate of example 1-1 | Filter comprising the substrate of example 1-2 | Filter comprising the substrate of example 1-3 | Filter comprising the substrate of example 1-4 | Filter comprising the substrate of example 1-5 | Filter made from crimped CF36 paper |
|---|---|---|---|---|---|---|---|
| Time required for the filter to disperse | >24 h | 20 sec | 20 sec | 20 sec | >24 h | 20 sec | 8 h |

The fibers of the filters from examples 1.1, 1.2, 1.3 and 1.5 come apart after 20 sec. The wood fibers of the filter made from crimped paper start to come apart from each other after 8 h. The paper filter is therefore less dispersible in water than the filter comprising the substrates of examples 1.1, 1.2, 1.3 and 1.5. After 24 h, the cellulose acetate filter and the filter of the invention of example 1.4 were unchanged. The cellulose acetate filter and the filter of example 1.4 do not disperse in the water.

The invention claimed is:

1. A filter comprising a nonwoven substrate comprising natural fibers and a binder, in which the natural fibers represent from 70% to 99% by weight of solids of said nonwoven substrate, the natural fibers being wood fibers chosen from hardwood pulp, bleached hardwood pulp, softwood pulp, bleached softwood pulp, softwood fluff pulp, and mixtures thereof, the binder represents from 1% to 30% by weight of solids of said nonwoven substrate, characterized in that the nonwoven substrate has a density of from 10 mg/cm$^3$ to 60 mg/cm$^3$.

2. The filter according to claim 1, in which the nonwoven substrate has a thickness of from 700 μm to 4000 μm.

3. The filter according to claim 1, in which the length of the natural fibers is from 1 mm to 10 mm.

4. The filter according to claim 1, in which the binder is a water-soluble binder.

5. The filter according to claim 4, in which the binder is chosen from a polysaccharide, a cellulose derivative, a polyvinyl alcohol and mixtures thereof.

6. The filter according to claim 1 for a smoking article or a vaping article.

7. A smoking article comprising a filter as defined in claim 1.

8. A vaping article comprising a filter as defined in claim 1.

9. A process for producing a filter for a smoking or vaping article comprising a nonwoven substrate, said process comprising the following steps:

a) forming a rod of nonwoven substrate from a nonwoven substrate, b) wrapping the rod of nonwoven substrate with a sheet of plug wrap paper, c) depositing an adhesive line, joining the sheet of plug wrap paper to obtain a rod of filtering material, d) cutting the rod of filtering material to produce the filter, wherein the nonwoven substrate is as defined in claim 1 and is obtained by a process comprising the following steps:

i) producing a web from natural fibers by an airlaid process, ii) introducing the binder into the web, and iii) drying the web resulting from step ii) to obtain the nonwoven substrate.

10. The process according to claim 9 in which, after step iii) and before step a), the nonwoven substrate is packed as bobbin, as roll by the spooling process or in paperboard by the festooning process.

11. The filter according to claim 1, wherein the nonwoven substrate has a density of from 10 mg/cm$^3$ to 45 mg/cm$^3$.

12. The filter according to claim 1, wherein the nonwoven substrate has a thickness of from 1200 μm to 4000 μm.

13. The filter according to claim 1, wherein the filter has a density of from 100 mg/cm$^3$ to 200 mg/cm$^3$.

14. The filter according to claim 1, wherein the nonwoven substrate is formed from an airlaid process.

15. The filter according to claim 1, wherein the natural fibers represent from 80% to 99% by weight of solids of said nonwoven substrate.

16. The filter according to claim 1, wherein the binder represents from 2% to 20% by weight of solids of said nonwoven substrate.

* * * * *